US010388139B2

(12) United States Patent
Mukundala et al.

(10) Patent No.: US 10,388,139 B2
(45) Date of Patent: Aug. 20, 2019

(54) METHOD AND APPARATUS FOR DETECTING AN EMERGENCY SITUATION IN A ROOM

(71) Applicant: CARRIER CORPORATION, Jupiter, FL (US)

(72) Inventors: Sumanth Kumar Mukundala, Telangana (IN); Adam Kuenzi, Silverton, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/899,709

(22) Filed: Feb. 20, 2018

(65) Prior Publication Data

US 2019/0197866 A1 Jun. 27, 2019

(51) Int. Cl.

| | |
|---|---|
| ***G08B 21/04*** | (2006.01) |
| ***G08B 26/00*** | (2006.01) |
| ***G08B 27/00*** | (2006.01) |

(52) U.S. Cl.

CPC ..... *G08B 21/0492* (2013.01); *G08B 26/008* (2013.01); *G08B 27/006* (2013.01)

(58) Field of Classification Search

CPC . G08B 21/0492; G08B 26/008; G08C 27/006
See application file for complete search history.

(56) References Cited

U.S. PATENT DOCUMENTS 5,165,465 A * 11/1992 Kenet ..... G08B 13/19 165/11.1
5,195,126 A * 3/1993 Carrier ..... G08B 25/006 379/45
7,061,393 B2 6/2006 Buckingham et al.
8,665,089 B2 3/2014 Saigh et al.
8,890,685 B1 11/2014 Sookman et al.
9,141,974 B2 9/2015 Jones et al.
9,408,041 B1 8/2016 Abehassera et al.
9,417,073 B2 8/2016 Warren
9,516,474 B2 12/2016 Finnerty et al.
9,538,332 B1 1/2017 Mendelson
9,641,965 B1 5/2017 Rapp et al.
9,704,377 B2 7/2017 Benoit et al.
9,794,755 B1 10/2017 South et al.
2012/0295575 A1 11/2012 Nam (Continued)

FOREIGN PATENT DOCUMENTS

| | | |
|---|---|---|
| EP | 2184724 A1 | 5/2010 |
| GB | 2013384 A | 8/1979 |
| WO | 2014091073 A1 | 6/2014 |

OTHER PUBLICATIONS

Avgoustinos Filippoupolitis et al.; Bluetooth Low Energy Based Occupancy Detection for Emergency Management; http://ieeexplore.ieee.org/document/7828580/; Dec. 14-16, 2016.

(Continued)

*Primary Examiner* — Omeed Alizada

(74) *Attorney, Agent, or Firm* — Cantor Colburn LLP

(57) ABSTRACT

A method of detecting an emergency situation in a room of a hotel is provided. The method comprising: monitoring an access control operably connect to a door of a room; determining that the access control has not been engaged; determining that activity has not been detected in the room for a selected time period; and activating an alarm.

20 Claims, 3 Drawing Sheets

(56) References Cited

U.S. PATENT DOCUMENTS

| | | | | |
|---|---|---|---|---|
| 2014/0266791 | A1* | 9/2014 | Lloyd | H04Q 9/00<br>340/870.09 |
| 2017/0127222 | A1 | 5/2017 | Lang et al. | |
| 2017/0180966 | A1 | 6/2017 | Piett et al. | |
| 2017/0195475 | A1 | 7/2017 | Mehta et al. | |

OTHER PUBLICATIONS

The Extended European Search Report for Application No. 18213395.9-1206; Report dated May 15, 2019; Report dated: May 29, 2019; 9 pages.

* cited by examiner

METHOD AND APPARATUS FOR DETECTING AN EMERGENCY SITUATION IN A ROOM

BACKGROUND

The subject matter disclosed herein generally relates to the field of access control systems, and more particularly to an apparatus and method for operating access control systems.

Existing access controls may allow a person to unlock hotel rooms via a key card and/or a mobile device. However if a person enters their hotel room there is no way to confirm whether or not they have physically left the hotel room, especially after a long period of time.

BRIEF SUMMARY

According to one embodiment, a method of detecting an emergency situation in a room of a hotel is provided. The method comprising: monitoring an access control operably connect to a door of a room; determining that the access control has not been engaged; determining that activity has not been detected in the room for a selected time period; and activating an alarm.

In addition to one or more of the features described above, or as an alternative, further embodiments may include that the activity includes at least one of motion and audible sounds.

In addition to one or more of the features described above, or as an alternative, further embodiments may include: determining that a telephone within the room has not received or transmitted a telephone call within the selected time period.

In addition to one or more of the features described above, or as an alternative, further embodiments may include detecting a mobile device within the room.

In addition to one or more of the features described above, or as an alternative, further embodiments may include that the mobile device is detected within the room using wireless communication.

In addition to one or more of the features described above, or as an alternative, further embodiments may include that the wireless communication includes at least one of Wi-Fi triangulation, zigbee, and Bluetooth signal strength.

In addition to one or more of the features described above, or as an alternative, further embodiments may include: determining that the room has not been cleaned within the selected time period.

In addition to one or more of the features described above, or as an alternative, further embodiments may include: determining that a window of the room has not been opened or closed within the selected time period.

In addition to one or more of the features described above, or as an alternative, further embodiments may include: transmitting a telephone call to a telephone within the room after the selected time period and not receiving an answer to the telephone call.

In addition to one or more of the features described above, or as an alternative, further embodiments may include that the selected time period is about equal to 24 hours.

According to another embodiment, a computer program product tangibly embodied on a computer readable medium is provided. The computer program product including instructions that, when executed by a processor, cause the processor to perform operations comprising: monitoring an access control operably connected to a door of a room; determining that the access control has not been engaged; determining that activity has not been detected in the room for a selected time period; and activating an alarm.

In addition to one or more of the features described above, or as an alternative, further embodiments may include that the activity includes at least one of motion and audible sounds.

In addition to one or more of the features described above, or as an alternative, further embodiments may include that the operations further comprise: determining that a telephone within the room has not received or transmitted a telephone call within the selected time period.

In addition to one or more of the features described above, or as an alternative, further embodiments may include that the operations further comprise: detecting a mobile device within the room.

In addition to one or more of the features described above, or as an alternative, further embodiments may include that the mobile device is detected within the room using wireless communication.

In addition to one or more of the features described above, or as an alternative, further embodiments may include that the wireless communication includes at least one of Wi-Fi triangulation, zigbee, and Bluetooth signal strength In addition to one or more of the features described above, or as an alternative, further embodiments may include that the operations further comprise: determining that the room has not been cleaned within the selected time period.

In addition to one or more of the features described above, or as an alternative, further embodiments may include the operations further comprise: determining that a window of the room has not been opened or closed within the selected time period.

In addition to one or more of the features described above, or as an alternative, further embodiments may include that the operations further comprise: transmitting a telephone call to a telephone within the room after the selected time period and not receiving an answer to the telephone call.

In addition to one or more of the features described above, or as an alternative, further embodiments may include that the selected time period is about equal to 24 hours.

Technical effects of embodiments of the present disclosure include determining an emergency situation in a room after detecting that no one has left the room over a selected period of time.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
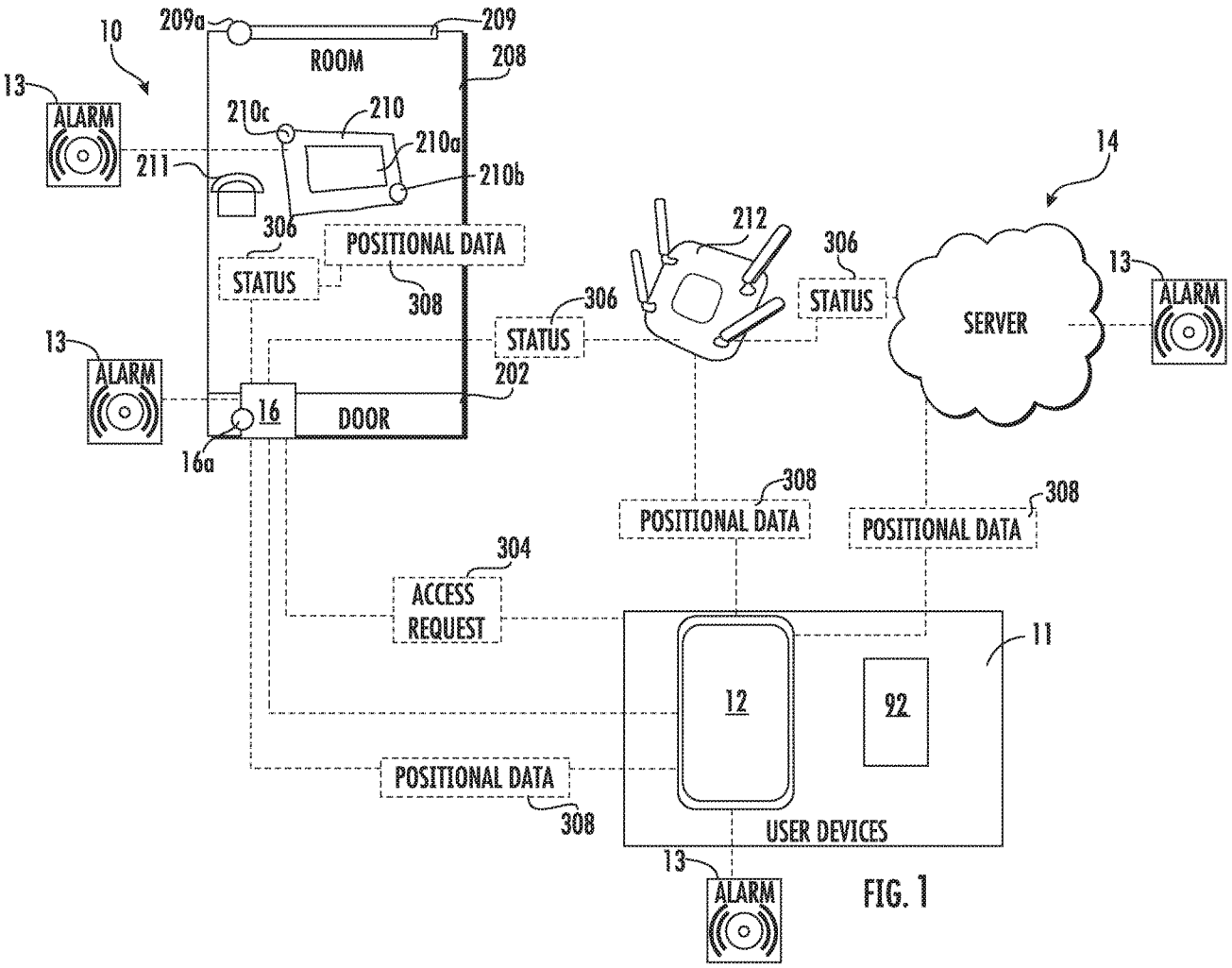
FIG. 1 illustrates a general schematic system diagram of an access control system, in accordance with an embodiment of the disclosure.

FIG. 1 schematically illustrates an access control system 10. The system 10 generally includes a user device 11, a server 14, a wireless access protocol device 212, a room management system 210, and an access control 16. It should be appreciated that while one access control 16 is illustrated, the access control system 10 may include any number of access controls 16. It should be appreciated that, although particular systems are separately defined in the schematic block diagrams, each or any of the systems may be otherwise combined or separated via hardware and/or software. In another embodiment, the access controls 16 may control access through a door 202 to a room 208. Each room 208 may include a window 209. It should be appreciated that while one door 202, one room 208, and one window 209 are illustrated, the access control system 10 may include any number of doors 202, rooms 208, and windows 209. Further, there may be multiple doors 202, windows 209, and access controls 16 for each room 208. A room management system 210 may be located in each room 208. The room management system 210 is configured to control operations of a room 208 including but not limited temperature and lighting. Each window 209 may include a sensor 209*a* to detect whether or not the window is open or closed. The sensor 209*a* is in electronic communication with the server 14. The sensor 209*a* may be in electronic communication with the server 14 through the wireless access protocol device 212 or the room management system 210. Each room 208 may also include a telephone 211 configured to receive and transmit telephone calls. The telephone 211 may be in electronic communication with the server 14. The telephone 211 may be in electronic communication with the server 14 through the wireless access protocol device 212 or the room management system 210.

For a selected period of stay (e.g. period of time for a person staying at a hotel) the user device 11 belonging to a person may be granted access to one or more access controls 16 (e.g. the door lock on a hotel room assigned to the person). When a person checks into the hotel room 208 their user device 11 will be granted access to a room 208. There may be one or more user devices 11 assigned to a room 208 (e.g. a husband and a wife), thus embodiments disclosed herein may apply to multiple user devices 11 per room 208. A person may utilize their user device 11 to unlock and/or lock the access control 16 operably connected to their assigned room 208 through an access request 304. The user device 11 may store credentials to unlock and/or lock the access control 16. Some credentials may be used for multiple access controls 16 if there are multiple access controls 16 for a single assigned room 208 or the person is assigned access to multiple rooms 208. For example, an access control 16 operably connected to a person's hotel room and an access control 16 operably connected to a hotel pool may respond to the same credential. Other credentials may be specific to a single access control 16.

The user device 11 may be a physical key card 92 and/or a mobile device 12. The user device 11 may transmit an access request 304 to the access control 16 by short-range radio transmission when the user device 11 is placed proximate the access control 16 or by the user device being inserted into the access control 16 for the access control to read the user device (e.g. a magnetic strip on an encoded card 92). The physical key card 92 is capable of being encoded with card data, such as, for example, a magnetic strip or RFID chip. The card data may include credentials to grant access to a specific access control 16. For example, for a period of stay for the user device 11 may be granted access to a specific access control 16. The mobile device 12 is a wireless capable handheld device such as a smartphone that is operable to communicate with the server 14 and the access controls 16. The server 14 may provide credentials and other data to the access control 16, such as firmware or software updates to be communicated to one or more of the access controls 16. Although the server 14 is depicted herein as a single device, it should be appreciated that the server 14 may alternatively be embodied as a multiplicity of systems, from which the mobile device 12 receives credentials and other data.

Each access control 16 may be a wireless-capable, restricted-access, or restricted-use device such as wireless locks, access control readers for building entry, and other restricted-use machines. The user device 11 submits credentials to the access controls 16, thereby selectively permitting a user to access or activate functions of the access controls 16. A user may, for example, submit a credential to an electromechanical lock to unlock it, and thereby gain access to a room 208.

The access control 16 is configured to advertise a status 306 of the access control 16. For example, the status 306 of the access control 16 may indicate whether the access control 16 is locked or unlocked, when the door 202 is opening or closing and/or when a handle (not shown) on the door 202 is being turned to open or close the door 202 and/or when a deadbolt (not shown) on the access control 16 is locked or unlocked. The status 306 of the access device 16 may be transmitted to the server 14 via a nearby mobile device 12, the wireless access protocol device 212, or directly from the access device 16 to the server 14 if they are in direct communication (e.g. a hardwired connection between the access device and the server 14). If the status 306 has not changed for a selected period of time (e.g. 24 hours) after a person entered than it may mean that a person has been in the room for the selected time period, which may indicate that there is a potential emergency situation in the room 208 (e.g. the person is unresponsive). If the status 306 indicates that a person has been in the room 208 for the selected time period (e.g. 24 hours) then the server 14 may check to see if there has been activity in the room. Activity may include motion and/or audible sounds. The room management system 210 may include a motion detector 210*c* configured to detect motion in the room 208. Some examples of Motion detectors 210*c* may include passive infrared sensors (PIR) that are typically used in motion sensors for security systems, a radar, or a video camera with built-in analytics for determining motion in the field of view of the camera. The room management system 210 may also include a microphone 210*b* configured to receive audible sounds from a person in the room 208. If no activity has been detected in the room for selected time period (e.g. 24 hours) and the status 306 indicates that no one has left the room 208 then it may indicate that there is an emergency situation in the room and an alarm 13 is activated through the server 14. The server 14 and/or the room management system 210 may be configured to determine whether there is an emergency situation in the room 208. An alarm 13 may be activated when an emergency situation is determined. The alarm 13 may be activated on the access control 16, the mobile device 12, the server 14, and/or the room management system 210. The alarm 13 may be audible, visual, and/or vibratory. The alarm 13 being activated may include transmitting a notification to front desk of a hotel and/or a technician. The notification may instruct someone to go check on the person in the room 208.

If the status 306 indicates that a person has been in the room 208 for the selected time period then the server 14 and/or the room management system 210 may check positional data 308 of the mobile device 12 in response to the status 306. Checking positional data 308 may include verifying that the mobile device 12 is not currently moving or experiencing any usage. Further, checking positional data 308 may include verifying that the data 308 indicates that the mobile device 12 has not moved or changed positions for a period of time. Positional data 308 of the mobile device 12 may include a location of the mobile device 12. The location of the mobile device 12 may be relative to the room 208 (e.g. whether or not the mobile device 12 is located in the room). The positional data 308 may also include a derivative of the location of the mobile device 12 that is indicative of movement by the mobile device 12. Movement may also be detected by a Microelectromechanical system (MEMS) 57, as described below. Positional data 308 may be determined as described below.

The access control 16 may be wirelessly connected to the wireless access protocol device 212 and communicate wirelessly to the mobile device 12. In a non-limiting embodiment, even if the access control 16 is wirelessly capable, communication between the mobile device 12 and the access control 16 may occur through the server 14. For example, the access control 16 may communication wirelessly through the wireless access protocol device 212 to the server 14 and then the server 14 may relay the communication wirelessly to the mobile device 12. In a further example, the mobile device 12 may communicate wirelessly to the server 14 and the server 14 may communicate wirelessly through the wireless access protocol device 212 to the access control 16. The communication between the server 14 and the mobile device 12 may occur through the wireless access protocol device 212 or another wireless network such as, for example, a cellular network. The access control 16 may be hardwired to the server 14 and thus communication between the mobile device 12 and the access control 16 may occur through the server 14. If the access control 16 is not hardwire connected to the server 14 or wirelessly connected to the server 14, the communication may occur between the access control 16 and the mobile device 12 via short range wireless communication, such as for example Wi-Fi, Bluetooth, zigbee, infrared, or any other short-range wireless communication method known to one of skill in the art. In an embodiment, the short-range wireless communication is Bluetooth. The mobile device 12 may have to be within a selected range of the access control 16 in order to utilize short-range wireless communication. The access control 16 may also be wired and/or wirelessly connect to the room management system 210. The access control 16 may be wirelessly connected to the room management system 210 through Wi-Fi, Bluetooth, zigbee, infrared or any other wireless connection known to one of skill in the art.

Figure 2:
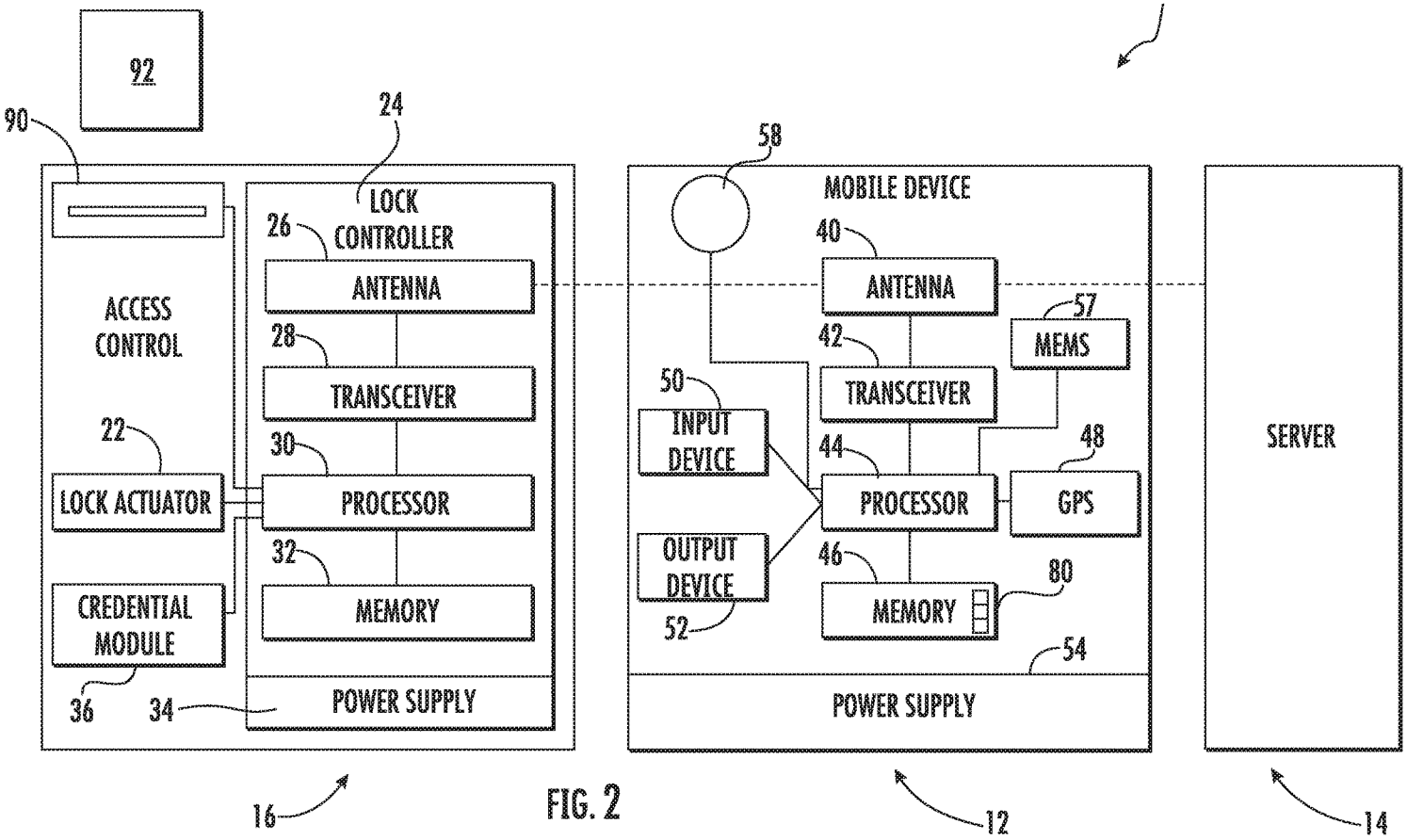
FIG. 2 illustrates a block diagram of an access control, mobile device and server of the access control system of FIG. 1, in accordance with an embodiment of the disclosure.

Referring now to FIG. 2 with continued reference to FIG. 1. FIG. 2 shows a block diagram of an example electronic lock system 20 includes the access control 16, the mobile device 12, and the server 14. The access control 16 generally includes a lock actuator 22, a lock controller 24, a lock antenna 26, a lock transceiver 28, a lock processor 30, a lock memory 32, a lock power supply 34, a lock card reader 90 and a credential module 36. The access control 16 may have essentially two readers, one reader 90 to read a physical key card 92 and the credential module 36 to communicate with the mobile device 12 via the lock processor 30 and the transceiver 28 and antenna 26. The access control 16 is responsive to credentials from the mobile device 12, and may, for example, be the lock of a door lock. Although the present disclosure focuses primarily on credentials for access control, it should be appreciated that other systems wherein credentials are transmitted from a mobile device to an access control so as to identify the user to an online system or validate user access rights or permissions in an offline system will benefit herefrom. Such systems include hotel door lock systems. Upon receiving and authenticating an appropriate credential from the mobile device 12 using the credential module 36, or after receiving card data from lock card reader 90, the lock controller 24 commands the lock actuator 22 to lock or unlock a mechanical or electronic lock. The lock controller 24 and the lock actuator 22 may be parts of a single electronic or electromechanical lock unit, or may be components sold or installed separately.

The lock transceiver 28 is capable of transmitting and receiving data to and from at least the mobile device 12. The lock transceiver 28 may, for instance, be a near field communication (NFC), Bluetooth, infrared, zigbee, or Wi-Fi transceiver, or another appropriate wireless transceiver. The lock antenna 26 is any antenna appropriate to the lock transceiver 28. The lock processor 30 and lock memory 32 are, respectively, data processing, and storage devices. The lock processor 30 may, for instance, be a microprocessor that can process instructions to validate credentials and determine the access rights contained in the credentials or to pass messages from a transceiver to a credential module 36 and to receive a response indication back from the credential module 36. The lock memory 32 may be RAM, EEPROM, or other storage medium where the lock processor 30 can read and write data including but not limited to lock configuration options. The lock power supply 34 is a power source such as line power connection, a power scavenging system, or a battery that powers the lock controller 24. In other embodiments, the lock power supply 34 may only power the lock controller 24, with the lock actuator 22 powered primarily or entirely by another source, such as user work (e.g. turning a bolt). The lock actuator 22 may be actuated manually from the inside of the room 208 (e.g. a dead bolt). For security, the lock actuator 22 may be actuated manually from the inside of the room 208, such as, for example, a dead bolt lock in a hotel room.

While FIG. 2 shows the lock antenna 26 and the transceiver 28 connected to the processor 30, this is not to limit other embodiments that may have additional antenna 26 and transceiver 28 connected to the credential module 36 directly. The credential module 36 may contain a transceiver 28 and antenna 26 as part of the credential module. Or the credential module 36 may have a transceiver 28 and antenna 26 separately from the processor 30 which also has a separate transceiver 28 and antenna 26 of the same type or different. In some embodiments, the processor 30 may route communication received via transceiver 28 to the credential module 36. In other embodiments the credential module may communicate directly to the mobile device 12 through the transceiver 28.

The mobile device 12 generally includes a key antenna 40, a key transceiver 42, a key processor 44, a key memory 46, a GPS receiver 48, an input device 50, an output device 52, a key power supply 54, and a Microelectromechanical system (MEMS) 57. The key transceiver 42 is a transceiver of a type corresponding to the lock transceiver 28, and the key antenna 40 is a corresponding antenna. In some embodiments, the key transceiver 42 and the key antenna 40 may also be used to communicate with the server 14. In other embodiments, one or more separate transceivers and antennas may be included to communicate with server 14. The key memory 46 is of a type to store a plurality of credentials locally on the mobile device 12. The mobile device 12 may also include a mobile device application 80. Embodiments disclosed herein, may operate through the mobile device application 80 installed on the mobile device 12. The mobile device 12 may also include a microphone 58 configured to receive audible commands from a person. The MEMS sensor 57 may be a sensor such as, for example, an accelerometer, a gyroscope, or a similar sensor known to one of skill in the art.

The positional data 308 may be detected using one or more methods and apparatus. The positional data 308 may be determined by the mobile device 12 and/or the server 14. The positional data 308 may be communicated to the RMS system 210, access control 16, or other device. The positional data 308 may include a location of the mobile device 12 and/or a movement of mobile device 12 that is a derivative of a location of the mobile device, such as, for example, velocity, acceleration, jerk, jounce, snap . . . etc. The mobile device 12 can determine by the GPS 48, by the MEMS 57, or by triangulating signals from the wireless access protocol device(s) 212 or signals from the access control(s) 16. The mobile device 12 may do calculations based on the received signal strength. The positional data 308 may be crude (i.e. close to access control or far away) or it may be very accurate (i.e. very precise) depending on the method used. The mobile device 12 may then initiate an alarm 13 by sending a message to the server 14, the wireless access protocol device 212, the room management system 210, or the access control 16 which could then activate alarms 13. The server 14 can determine by receiving signals from the wireless access protocol device(s) 212 of signals sent from the mobile device (i.e. a Bluetooth beacon or something). The server then could do the alarm, it could send a message to the mobile device 12, the wireless access protocol device 212, the room management system 210, or the access control 16, which could then activate alarms 13.

The location of the mobile device 12 may also be detected through triangulation of wireless signals emitted from the mobile device 12 or signal strength between the mobile device 12 and the wireless access protocol device 212. The location of the mobile device 12 may be detected using any other desired and known location detection/position reference means. In a non-limiting embodiment, activity within the room 208 may also be detected through positional data 308 from the mobile device 12

Figure 3:
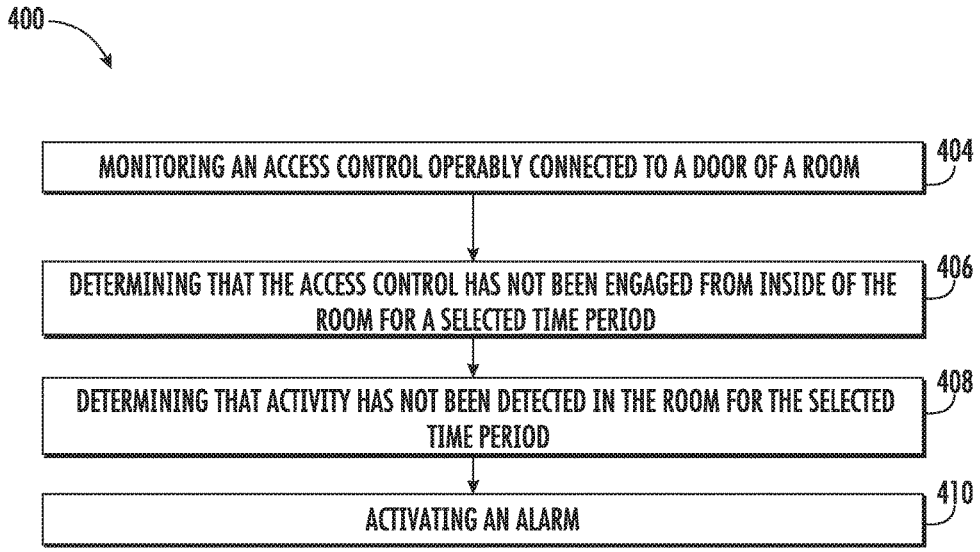
FIG. 3 is a flow diagram illustrating a method of detecting a potential emergency situation in a room of a hotel, according to an embodiment of the present disclosure.

Referring now to FIG. 3 with continued reference to FIGS. 1-2. FIG. 3 shows a flow chart of method 400 of detecting an emergency situation in a room 208 of a hotel, in accordance with an embodiment of the disclosure. At block 404, an access control 16 operably connected to a door 202 of a room 208 is monitored. As describe above, the access control 16 may be a lock on the door 202 having a lock (e.g. a dead bolt lock) that may only be unlocked from inside of the room 208. At block 406, it is determined that the access control 16 has not been engaged from inside of the room 208 for a selected time period. For example, a dead bolt lock of the access control 16 may have been engaged for the selected time period. In an embodiment, the selected time period may be about 24 hours.

At block 408, it is determined that activity has not been detected in the room 208 for the selected time period. The activity includes at least one of motion and audible sounds. If activity has not been detected within the room 208 within the selected time period then it may be indicative that an emergency situation is present (e.g. the person in the room 208 is unresponsive). At block 410, an alarm 13 is activated. The alarm 13 may be activated on the access control 16, the mobile device 12, the server 14, and/or the room management system 210. The alarm 13 may be audible, visual, and/or vibratory, as described above. The alarm 13 being activated may include transmitting a notification to front desk at a hotel and/or a technician. The notification may indicate that no activity has been detected in the room 208 over the selected period of time and someone should check on the person staying in the room.

The method 400 may also include prior to activating the alarm 13: determining that a telephone 211 within the room 208 has not received or transmitted a telephone call within the selected time period. Incoming telephone calls being answered and/or outgoing telephone calls may be indicative that a person is still responsive and no emergency situation is present. The server 14 may be configured to determine that the telephone 211 within the room 208 has not received or transmitted a telephone call within the selected time period.

The method 400 further also includes prior to activating the alarm 13: detecting a mobile device 12 within the room 208 using the positional 308, as described above. If a mobile device 12 is within the room 208 and activity has not been detected within the selected time period then it may be indicative that an emergency situation is present (e.g. the person in the room 208 is unresponsive). The mobile device 12 may be detected within the room 208 using Wi-Fi triangulation and/or Bluetooth signal strength.

The method 400 may also include prior to activating the alarm 13: determining that the room 208 has not been cleaned within the selected time period. The room 208 having been cleaning by a house keeper within the selected time period may be indicative that a person is still responsive and no emergency situation is present because the housekeeper should have notice an emergency situation while cleaning the room 208. Records of cleaning kept by housekeeping may be stored on the server 14. The method 400 further also include prior to activating the alarm 13: determining that a window 209 of the room has not been opened or closed within the selected time period using the sensor 209*a* operably connected to the window 209. Data from the sensor 209*a* may be transmitted to the server 14 and/or the room management system 210, as described above. The server 14 and/or the room management system 210 may be configured to determine whether or not the window 209 has been opened. An open window 209 may indicate that a person left the room 208 through the window 209. After determining that there has not been activity within the room 208 for the selected time period but before transmitting the alarm 13 the method 400 may further include transmitting a telephone call to a telephone 211 within the room 208. The telephone call may be transmitted automatically to the telephone 211 by the server 14 and/or the room management system 210. If an answer is not received to the telephone call then it may be indicative that an emergency situation is present (e.g. the person in the room 208 is unresponsive).

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system of detecting an emergency situation in a room of a hotel, the system comprising:

a processor; and a memory comprising computer-executable instructions that, when executed by the processor, cause the processor to perform operations, the operations comprising:

monitoring a door lock operably connected to a door of a room, the door lock comprising a dead bolt lock that can be actuated manually from inside the room;

detecting actuation of the dead bolt from an unlocked position to a locked position;

determining that the dead bolt has not been moved from the locked position to the unlocked position for a first selected time period;

determining that activity has not been detected in the room for a second selected time period; and activating an alarm.

2. The system of claim 1, wherein the activity includes at least one of motion and audible sounds.

3. The system of claim 1, wherein the operations further comprise:

determining that a telephone within the room has not received or transmitted a telephone call within the second selected time period.

4. The system of claim 1, wherein the operations further comprise:

detecting a mobile device within the room.

5. The system of claim 4, wherein:

the mobile device is detected within the room using wireless communication.

6. The system of claim 5, wherein:

the wireless communication includes at least one of Wi-Fi triangulation, zigbee, and Bluetooth signal strength.

7. The system of claim 1, wherein the operations further comprise:

determining that the room has not been cleaned within the second selected time period.

8. The system of claim 1, wherein the operations further comprise:

determining that a window of the room has not been opened or closed within the second selected time period.

9. The system of claim 1, wherein the operations further comprise:

transmitting a telephone call to a telephone within the room after the second selected time period and not receiving an answer to the telephone call.

10. The system of claim 1, wherein:

the first selected time period is about equal to 24 hours.

11. A computer program product tangibly embodied on a non-transitory computer readable medium, the computer program product including instructions that, when executed by a processor, cause the processor to perform operations comprising:

monitoring a door lock operably connected to a door of a room, the door lock comprising a dead bolt lock that can be actuated manually from inside the room;

detecting actuation of the dead bolt from an unlocked position to a locked position;

determining that the dead bolt has not been moved from the locked position to the unlocked position for a first selected time period;

determining that activity has not been detected in the room for a second selected time period; and activating an alarm.

12. The computer program product of claim 11, wherein the activity includes at least one of motion and audible sounds.

13. The computer program product of claim 11, wherein the operations further comprise:

determining that a telephone within the room has not received or transmitted a telephone call within the second selected time period.

14. The computer program product of claim 11, wherein the operations further comprise:

detecting a mobile device within the room.

15. The computer program product of claim 14, wherein: the mobile device is detected within the room using wireless communication.

16. The computer program product of claim 15, wherein: the wireless communication includes at least one of Wi-Fi triangulation, zigbee, and Bluetooth signal strength.

17. The computer program product of claim 11, wherein the operations further comprise:

determining that the room has not been cleaned within the second selected time period.

18. The computer program product of claim 11, wherein the operations further comprise:

determining that a window of the room has not been opened or closed within the second selected time period.

19. The computer program product of claim 11, wherein the operations further comprise:

transmitting a telephone call to a telephone within the room after the second selected time period and not receiving an answer to the telephone call.

20. The computer program product of claim 11, wherein: the first selected time period is about equal to 24 hours.

* * * * *